US007004656B2

(12) United States Patent
Kurihara et al.

(10) Patent No.: US 7,004,656 B2
(45) Date of Patent: Feb. 28, 2006

(54) STICK-LIKE PAINT CONTAINER

(75) Inventors: Mitsuru Kurihara, Sayama (JP); Mitsunobu Nakamura, Sayama (JP); Kazutsugu Iwasaki, Sayama (JP); Shigeto Imabeppu, Tokyo (JP); Kei Arai, Tokyo (JP)

(73) Assignee: KOSE Corporation, Tokyo (JP)

( * ) Notice: Subject to any disclaimer, the term of this patent is extended or adjusted under 35 U.S.C. 154(b) by 0 days.

(21) Appl. No.: 10/489,851

(22) PCT Filed: Sep. 26, 2002

(86) PCT No.: PCT/JP02/09935

§ 371 (c)(1),
(2), (4) Date: Mar. 23, 2004

(87) PCT Pub. No.: WO03/028502

PCT Pub. Date: Apr. 10, 2003

(65) Prior Publication Data

US 2004/0265033 A1 Dec. 30, 2004

(30) Foreign Application Priority Data

Sep. 28, 2001 (JP) ..... 2001-299676

(51) Int. Cl.
*B43K 21/08* (2006.01)

(52) U.S. Cl. ..... 401/75; 401/78; 401/87

(58) Field of Classification Search ..... 401/68, 401/71, 75, 77, 78, 86, 87
See application file for complete search history.

(56) References Cited

U.S. PATENT DOCUMENTS 3,547,551 A * 12/1970 Gruska ..... 401/78
5,746,530 A * 5/1998 Oota ..... 401/88
5,873,379 A * 2/1999 Bouix ..... 132/318

(Continued)

FOREIGN PATENT DOCUMENTS

EP 0 379 607 8/1990

(Continued)

OTHER PUBLICATIONS

U.S. Appl. No. 10/522,376, filed Jan. 26, 2005, inventor Kurihara et al.

*Primary Examiner*—Justine R. Yu
*Assistant Examiner*—Huyen Le
(74) *Attorney, Agent, or Firm*—Oblon, Spivak, McClelland, Maier & Neustadt, P.C.

(57) ABSTRACT

A stick-type cosmetic container, comprising an internal structure having a rotational cylinder, a sleeve, and an inner container for filling a stick-type cosmetic therein and allowing the stick-type cosmetic filled in the inner container to be projected and retracted by guiding a small projection provided on the inner container by an inner container guiding groove provided in the sleeve and vertically moving the small projection by a screw threaded in the inner surface of the rotational cylinder, characterized in that the inner container guiding groove provided in the sleeve inside the internal structure is formed of a primary linear groove having a closed bottom end and a secondary groove branched on the way of the primary groove, formed in an approximately inverse J-shape and having an open bottom end, whereby, in normal use, the inner container is not fallen down and, when the stick-type cosmetic is used up, the inner container can be easily disassembled and a member can be easily replaced by using a simple jig, and the stick-type cosmetic container can be used for those cosmetics such as lipstick, lip cream, concealer, skin whitening stick, and sun-burn stick.

3 Claims, 10 Drawing Sheets

U.S. PATENT DOCUMENTS

| | | | | | |
|---|---|---|---|---|---|
| 5,899,621 | A * | 5/1999 | Wang | 401/78 | |
| 5,988,917 | A | 11/1999 | Sheffler et al. | | |
| 2004/0265033 | A1 | 12/2004 | Kurihara et al. | | |

FOREIGN PATENT DOCUMENTS

| | | |
|---|---|---|
| JP | 2002-223847 | 8/2002 |

* cited by examiner

STICK-LIKE PAINT CONTAINER

TECHNICAL FIELD

The present invention relates to a container for a stick-type cosmetic. More particularly, the present invention relates to a container for a stick-type cosmetic which has a small number of components and can be easily disassembled and assembled. The stick-type cosmetic container is used by placing an internal structure having a function of allowing a stick-type cosmetic filled in an inner container to be projected and retracted in an outer cylinder or exterior container.

BACKGROUND ART

A stick-type cosmetic container in which a stick-type cosmetic filled therein is projected and retracted by rotating an outer cylinder is widely used as a container for lipsticks and other cosmetics such as lip creams and concealers because of its ease of use.

As shown in FIG. 1, a conventional stick-type cosmetic container comprises a rotational cylinder 7, sleeve 2, inner container 5 filled with a stick-type cosmetic, outer cylinder 12, and junction 13, for example. In FIG. 1, the view on the right is a cross-sectional view substantially showing only the inner container 5 (the stick-type cosmetic is not shown), and the view on the left is a cross-sectional view showing a state in which the sleeve 2, outer cylinder 12, and junction 13 are removed.

In the cosmetic container, a small projection 6 is provided in the lower part of the outer surface of the inner container 5, and an inner container guiding groove 4 is provided in the sleeve 2. The screw 8 is threaded on the inner surface of the rotational cylinder 7. When the stick-type cosmetic container is assembled, the junction 13 plays a role in integrating the rotational cylinder 7 with the sleeve 2. The outer cylinder 12 covers the rotational cylinder 7 encompassingly and is secured to the junction 13 by ultrasonic welding, bonding using an adhesive, or the like.

In the stick-type cosmetic container 1, the outer cylinder 12 is secured to the junction 13 and is integrated with the rotational cylinder 7. When the outer cylinder 12 is rotated, the rotational cylinder 7 is also rotated. The small projection 6 in the inner container 5 is moved up and down along the inner container guiding groove 4 in the sleeve 2 according to the rotation of the screw 8 in the rotational cylinder 7. The stick-type cosmetic is projected and retracted according to this movement.

In this manner, the small projection 6 in the inner container 5 is moved up and down along the inner container guiding groove 4 in the sleeve 2 according to the rotation of the rotational cylinder 7. However, if the small projection 6 is moved endlessly, the inner container 5 finally drops out of the sleeve 2. Therefore, movement of the small projection 6 in the inner container 5 must be limited within a certain range. In a conventional stick-type cosmetic container, the inner container 5 is prevented from dropping out by closing one end of the inner container guiding groove 4, holding the opening of the inner container guiding groove 4 by the outer cylinder 12 from outside so that the inner container does not drop out, or not threading the screw 8 on the inner surface of the rotational cylinder 7 to the end.

A conventional stick-type cosmetic container having the above configuration has no problem when the container is used as a disposable container. However, the container is highly inconvenient for use in terms of replacement of the inner container 5, separate disposal of the metal and resin, and the like. Since the inner container 5 is configured not to drop out, the inner container 5 can be replaced by disassembly of the cosmetic container. However, the disassembly is practically impossible because the outer cylinder 12 is secured to the junction 13.

As resource saving and recycling are trends in recent years, cosmetic containers which can be refilled or replaced become preferred. However, due to the above-mentioned reasons, a stick-type cosmetic container for which filling, disassembly, assembly, and separate disposal can be easily performed has not yet been provided. In view of resource saving, a stick-type cosmetic container having a small number of components and having members that can be commonly used for different types of products has been demanded.

Therefore, an object of the present invention is to provide a stick-type cosmetic container for which filling, disassembly, assembly, and separate disposal can be easily performed, and of which the inner container does not drop out during normal use.

Another object of the present invention is to provide a stick-type cosmetic container comprising an internal structure of which the number of components is smaller than that of a conventional product and the members are commonly used for different types of products.

DISCLOSURE OF THE INVENTION

The present inventors have conducted extensive studies to achieve the above objects. As a result, the inventors have found that refilling and replacement can be easily performed only for the inner container filled with a stick-type cosmetic, while the inner container can be prevented from dropping out during normal use, by improving the shape of the inner container guiding groove provided in the sleeve.

The inventors have also found that it is not necessary to provide the junction for securing the inner container in order to prevent dropout used in a conventional stick-type cosmetic container, when a plurality of pawls are provided in the rotational cylinder and engaged with a rib provided on the outer surface approximately at the center of the sleeve. These findings have led to the completion of the present invention.

Specifically, the present invention provides a stick-type cosmetic container comprising an internal structure that has a rotational cylinder, sleeve, and inner container into which a stick-like cosmetic can be filled, and that can project and retract the stick-type cosmetic filled into the inner container when a small projection provided in the inner container is guided by an inner container guiding groove provided in the sleeve and the small projection is moved up and down by a screw threaded on the inner surface of the rotational cylinder, wherein the inner container guiding groove provided in the sleeve in the internal structure comprises a linear primary groove, with the lower end being closed, and a secondary groove branched on the way of the primary groove and having an approximately inverted J shape, with the lower end being opened.

The present invention also provides the stick-type cosmetic container further comprising a joining means provided in the rotational cylinder and the sleeve for rotatably joining the rotational cylinder and the sleeve, wherein the joining means comprises a plurality of pawls provided in the upper part of the rotational cylinder and a cyclic rib provided on the outer surface approximately at the center of the sleeve, the pawls being engaged with the cyclic rib to rotatably join the rotational cylinder and the sleeve.

BEST MODE FOR CARRYING OUT THE INVENTION

The present invention will be described in more detail with reference to the drawings showing one embodiment of the present invention. However, the present invention is not limited to this embodiment.

Figure 2:
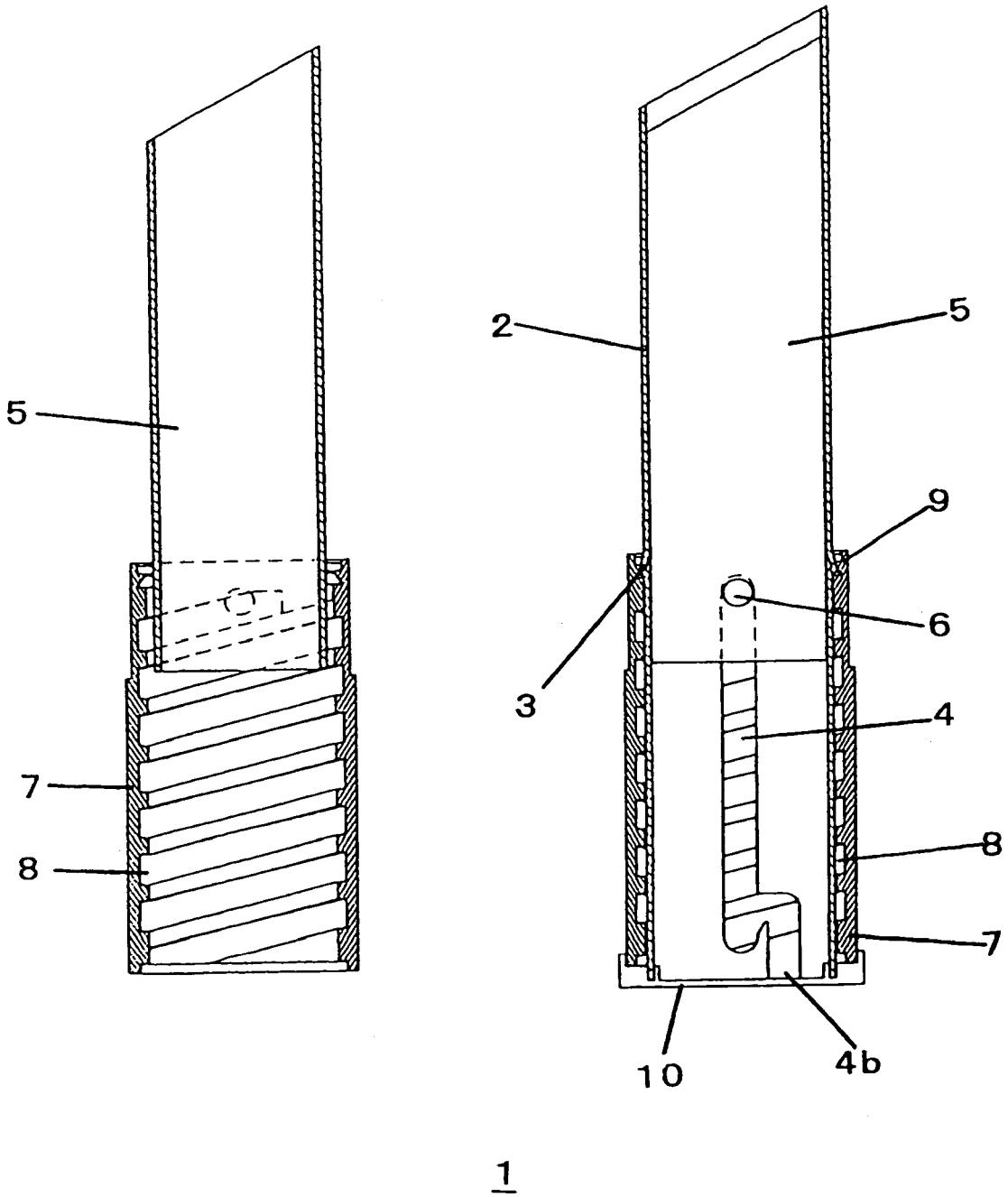
FIG. 2 is a drawing showing an example of an internal structure used in the stick-type cosmetic container of the present invention. The inner container is located in the uppermost part.

FIG. 2 is a drawing showing a configuration of an internal structure used in the stick-type cosmetic container of the present invention. (An exterior container is not shown.) In FIG. 2, the view on the right is a cross-sectional view substantially showing only the inner container, and the view on the left is a cross-sectional view showing a state in which a sleeve 2 is removed. (A stick-type cosmetic is not shown.) In FIG. 2, 1 indicates an internal structure of the stick-type cosmetic container, 2 indicates a sleeve, 3 indicates a cyclic rib, 4 indicates a inner container guiding groove, 4*b* indicates a secondary groove, 5 indicates an inner container, 6 indicates a small projection, 7 indicates a rotational cylinder, 8 indicates a screw, 9 indicates a pawl, and 10 indicates a bottom lid.

The stick-type cosmetic container of the present embodiment basically comprises a rotational cylinder 7 of which the inner surface is threaded by a screw 8, a sleeve 2, and an inner container 5 filled with a stick-type cosmetic. The shape of an inner container guiding groove 4 provided in the sleeve 2 significantly differs from the shape of the inner container guiding groove 4 of a conventional stick-type cosmetic container.

Figure 3:
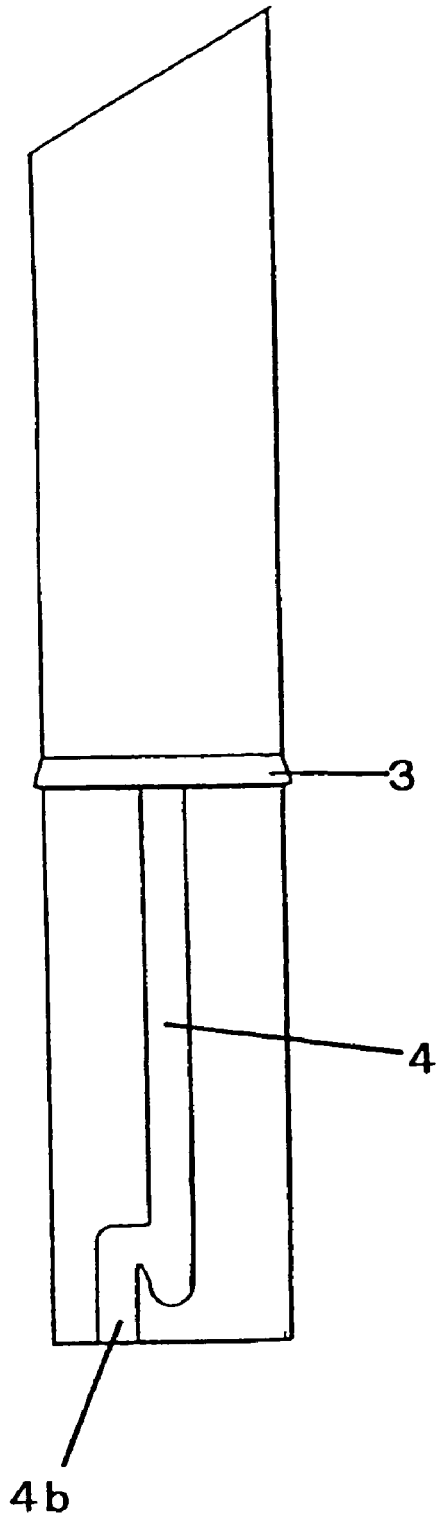
FIG. 3 is a drawing showing the shape of a sleeve used in the internal structure as shown in FIG. 2.

The shape of the sleeve 2 used in the present embodiment is shown in FIG. 3. The inner container guiding groove 4 of the sleeve 2 branches into a primary groove and a secondary groove 4*b* at the lower end. The shape of the secondary groove 4*b* (including the lowermost part of the primary groove) is an approximately inverted J shape. The secondary groove 4*b* is opened downward. In these respects, the sleeve 2 differs from the sleeve 2 of a conventional stick-type cosmetic container.

Figure 4:
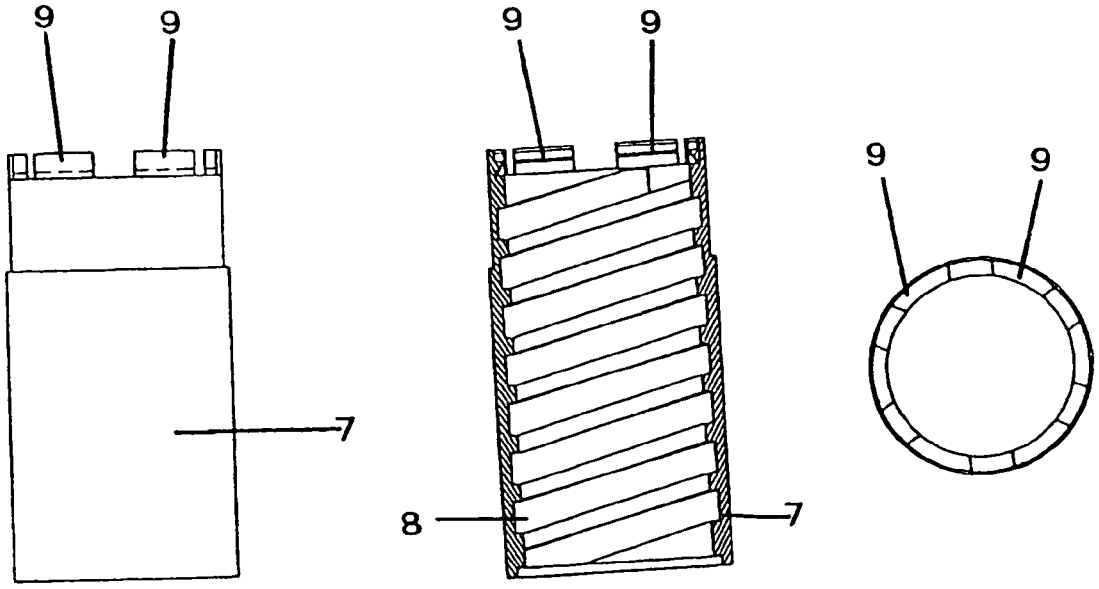
FIG. 4 is a drawing showing the shape of a rotational cylinder used in the internal structure as shown in FIG. 2. In the drawing, the view on the left is a front view, the view at the center is a cross-sectional view, and the view on the right is a plan view.

As shown in the cross-sectional view at the center of FIG. 4, the rotational cylinder 7 differs from a conventional rotational cylinder 7 in that a plurality of pawls 9 are provided in the upper part and that the screw 8 is threaded to the end in the downward direction (opened) but is not threaded to the end in the upward direction (closed). The pawls 9 in the rotational cylinder 7 preferably have concave portions on the inner surface.

Figure 5:
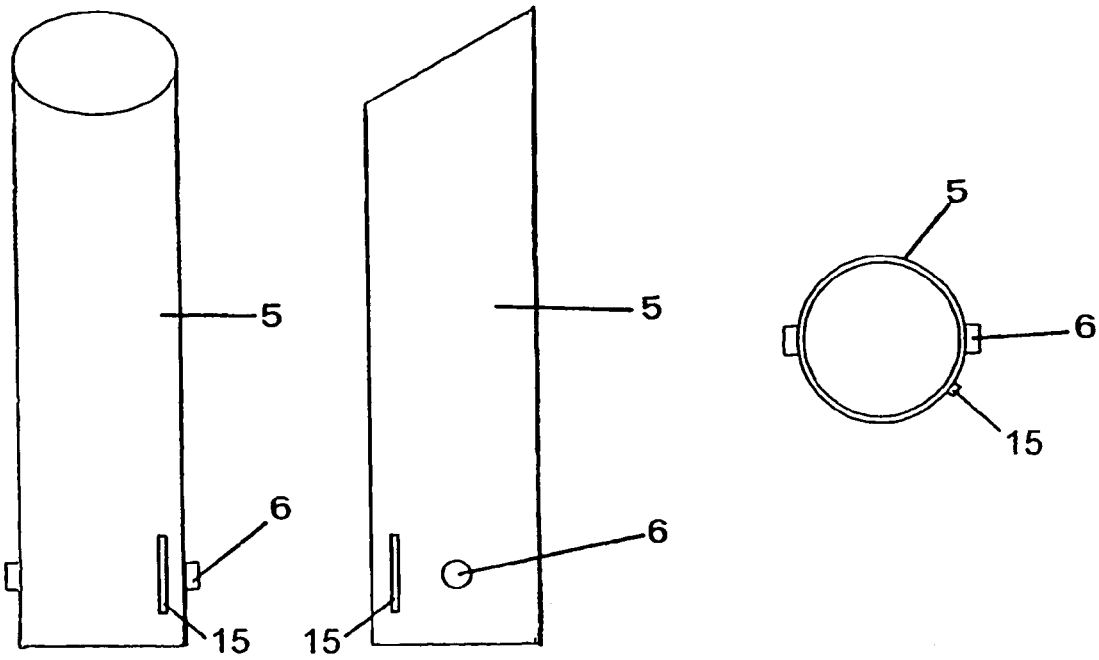
FIG. 5 is a drawing showing the shape of an inner container used in the internal structure as shown in FIG. 2. In the drawing, the view on the left is a front view, the view at the center is a right side view, and the view on the right is a plan view.

As shown in FIG. 5, the inner container 5 used in combination with the sleeve 2 is a cylinder of which the lower part has a small projection 6. The upper and lower parts of the inner container 5 are opened. However, as described later, since a molten stick-type cosmetic is solidified in the inner container 5 and secured to the container, the cosmetic does not drop out of the container. The inner surface of the inner container 5 may be optionally provided with a dropout-preventing projection (not shown) to prevent the filled stick-type cosmetic from dropping out of the inner container 5. The small projection 6 may have any shape inasmuch as the projection 6 can be moved in the inner container guiding groove 4 by the rotational force of the screw 8. However, the shape is preferably cylindrical or hemispheric, generally. The outer surface of the inner container 5 may be optionally provided with a suppressing section 15 to reduce the space between the inner container 5 and the sleeve 2 and suppress rattling. Any shape may be employed for the suppressing section 15 without specific limitations insofar as rattling of the inner container 5 and the sleeve 2 can be suppressed.

One of the features of the present invention is that disassembly, assembly, and replacement of the inner container 5 can be easily performed, while the inner container 5 filled with a stick-type cosmetic does not drop out during normal use. The mechanism possessing this feature will be described with reference to FIGS. 6 and 8.

Figure 6:
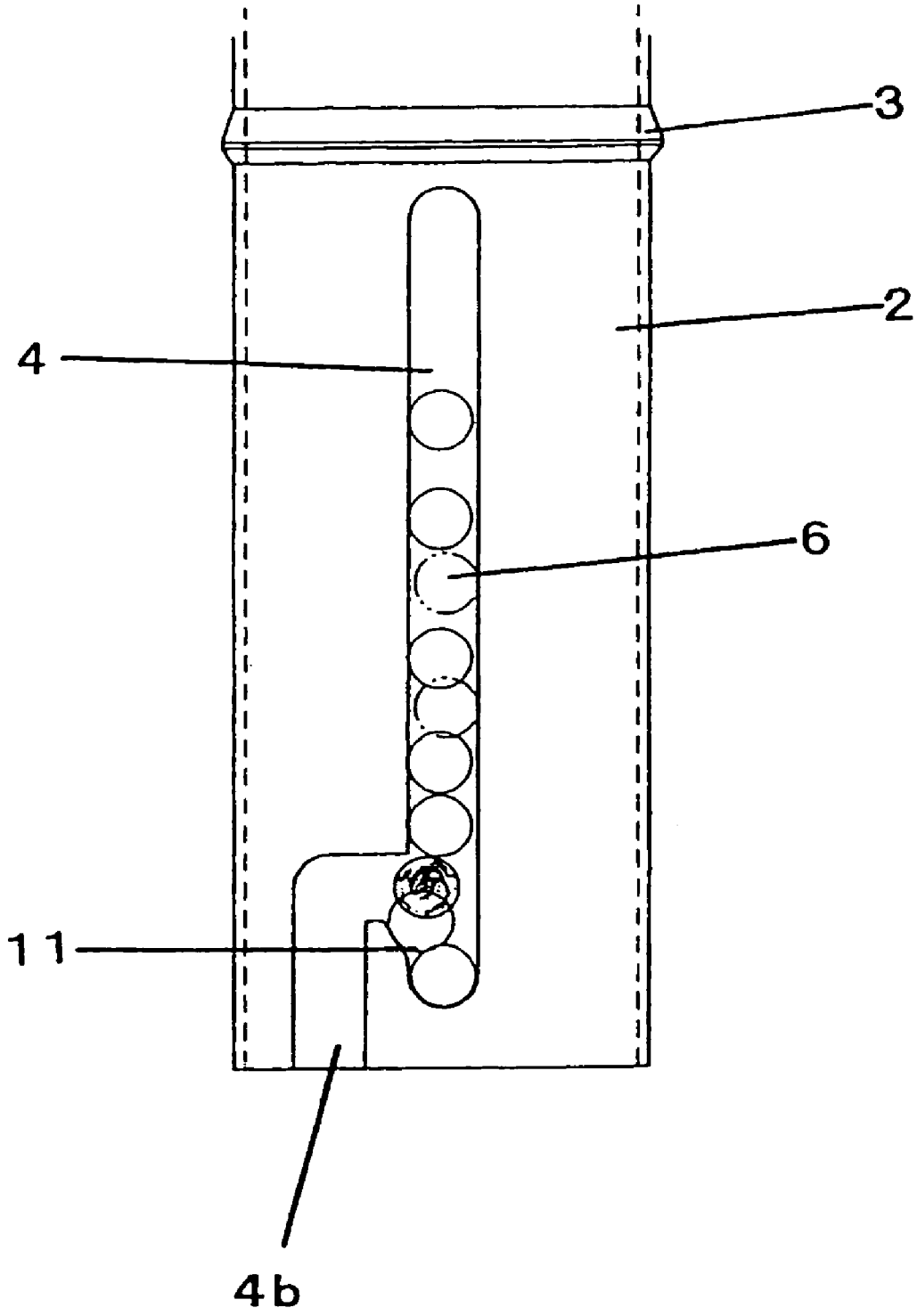
FIG. 6 is a drawing showing the relation between an inner container guiding groove and a small projection provided in the inner container in the internal structure as shown in FIG. 2.

When the rotational cylinder 7 of the stick-type cosmetic container of the present invention is rotated to the left with respect to the sleeve 2, a force in the lower leftward direction is applied to the small projection 6 indicated as the circle in FIG. 6 by the screw 8 provided in the rotational cylinder 7 indicated as the oblique lines. However, since the small projection 6 is guided by the inner container guiding groove 4 in the sleeve 2, the projection 6 cannot be moved to the left beyond the groove 4. The projection 6 is moved down along the left side of the inner container guiding groove 4 (A in FIG. 8). The inner container 5 is moved down accordingly.

When the small projection 6 reaches the entrance of the secondary groove 4*b* (the position indicated as the black circle in FIG. 6), since there is no guiding groove on the left, the projection 6 is moved further to the left. However, since the force of causing this leftward movement is a force in the direction perpendicular to the gradient of the screw 8, the small projection 6 hits a small projection support 11 provided according to the gradient of the screw 8 and is returned to the primary groove. The small projection 6 is then moved down and stored in a primary groove lowermost part 14 (C in FIG. 8). Since the bottom of the primary groove is closed, the small projection 6 cannot be moved further downward. The inner container 5 stops accordingly. Here, a force in the axial direction is not applied to the rotational cylinder 7.

When the rotational cylinder 7 is rotated to the right with respect to the sleeve 2, a force in the upper rightward direction is applied to the small projection 6 by the screw 8 in the rotational cylinder 7. The projection 6 is moved up along the right side of the inner container guiding groove 4, finally reaches the closed upper end of the screw 8 in the rotational cylinder 7, and stops (B in FIG. 8). Here, a force in the axial direction is not applied to the rotational cylinder 7.

Based on this mechanism, the inner container 5 can be moved up and down in the sleeve 2 without dropping out downward.

Figure 7:
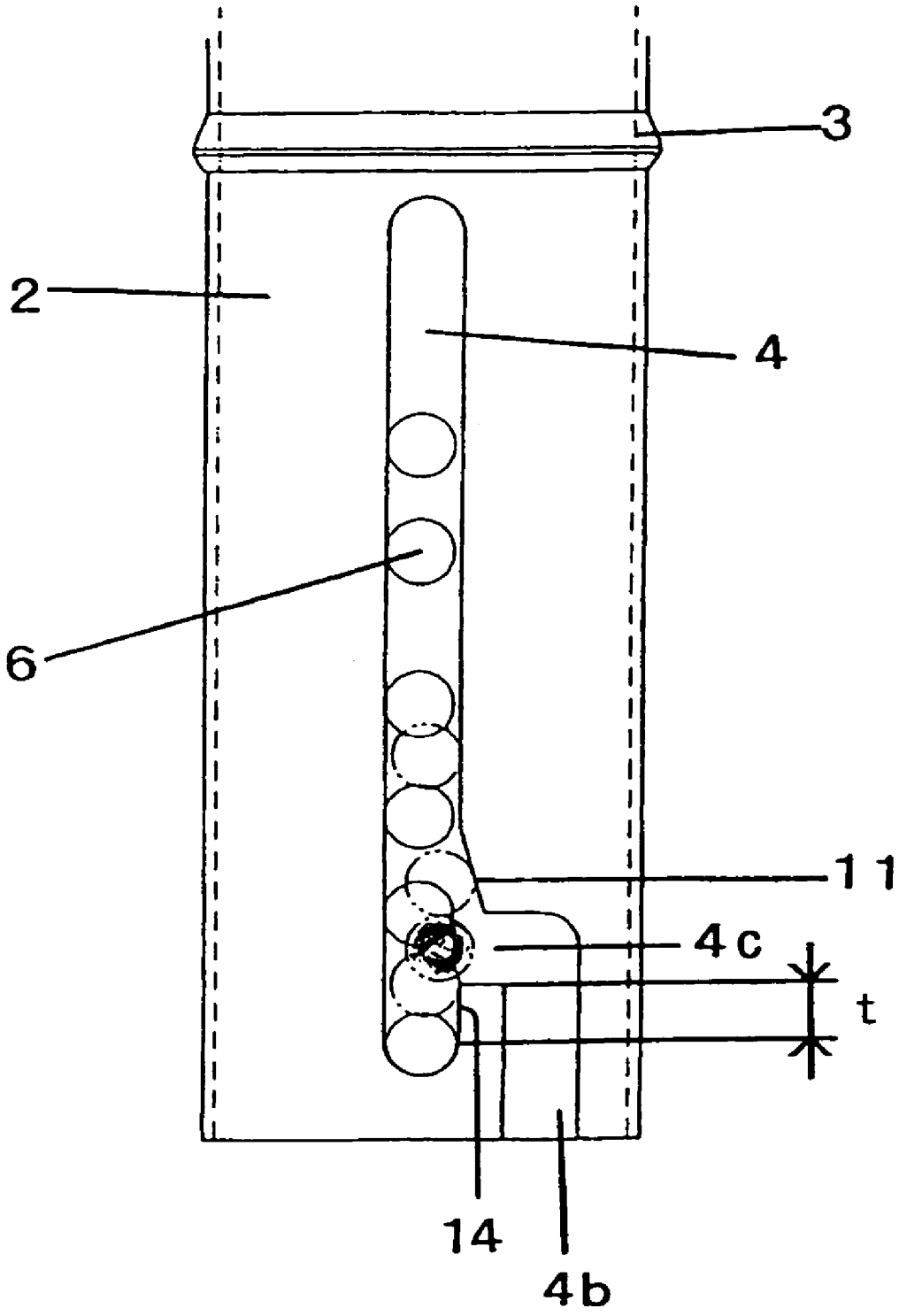
FIG. 7 is a drawing showing the relation between an inner container guiding groove and a small projection provided in an inner container in another example of the internal structure.

A mechanism similar to the mechanism using the inner container guiding groove 4 shown in FIG. 6 can also be realized by utilizing the groove 4 shown in FIG. 7. In FIG. 7, the secondary groove 4*b* is provided on the side opposite to the side of the inner container guiding groove 4 in FIG. 6. In this example, when the rotational cylinder 7 is rotated to the left with respect to the sleeve 2, the small projection 6 in the inner container 5 is moved along the left side of the inner container guiding groove 4 and directly reaches the primary groove lowermost part 14.

When the rotational cylinder 7 is rotated to the right with respect to the sleeve 2 to let out a stick-type cosmetic, a force in the upper rightward direction is applied to the small projection 6 in the primary groove lowermost part 14 by the rotational force of the screw 8. The small projection 6 is first moved from the primary groove lowermost part 14 in the upper perpendicular direction by this force. When the small projection 6 reaches the entrance of the secondary groove 4*b* (the position indicated as the black circle in FIG. 7), since there is no guiding groove on the right, the projection 6 is moved further to the right. However, since the force of causing this rightward movement is a force in the direction perpendicular to the gradient of the screw 8, the small projection 6 hits the small projection support 11 provided corresponding to this force direction. The projection 6 is then returned to the primary groove and continues moving up.

Based on this mechanism, the small projection 6 can be moved up and down within a certain range, while the inner container 5 is not detached from the inner container guiding groove 4, even if the inner container guiding groove 4 is provided with the secondary groove 4*b*.

Figure 9:
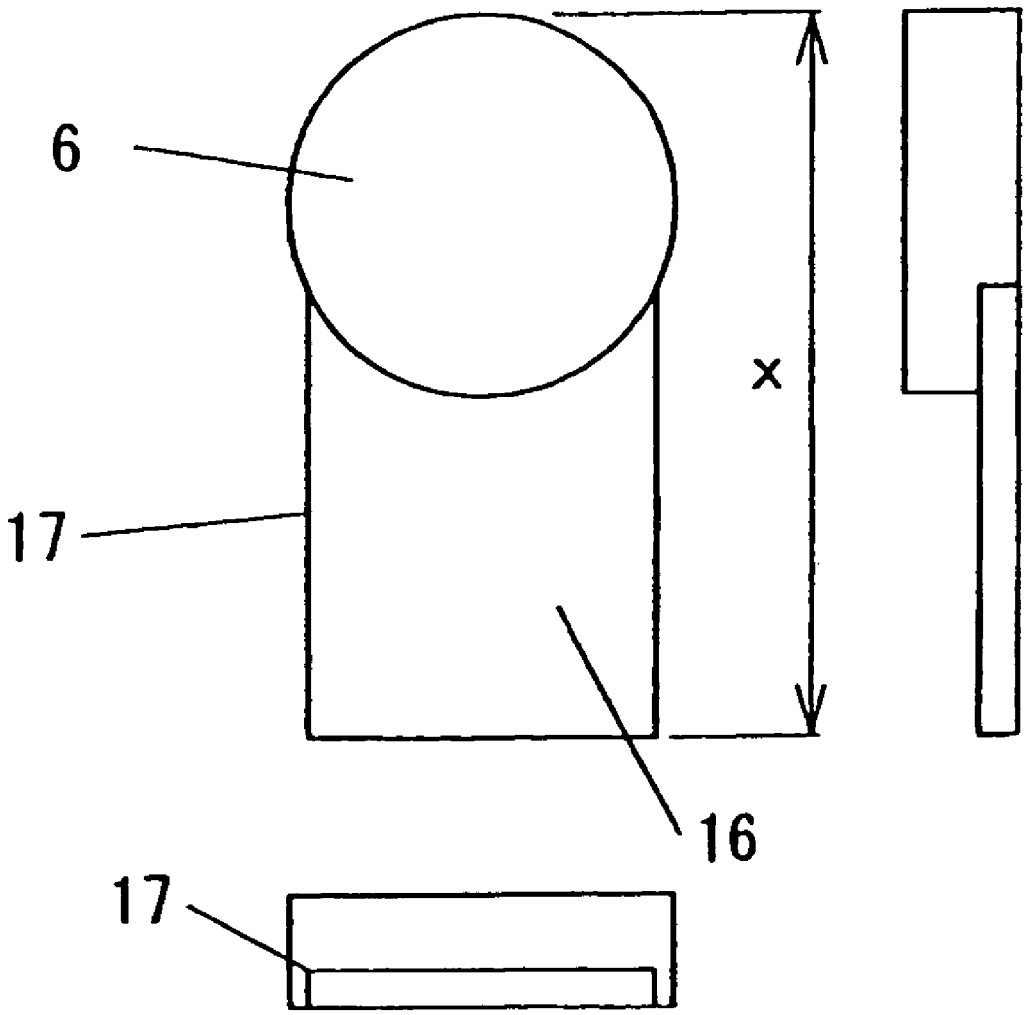
FIG. 9 is a drawing showing an example in which the small projection in the inner container used in the internal structure is provided with a resistive section. In the drawing, the view on the left is a front view, the view on the right is a right side view, and the view on the lower left is a bottom view.

As described above, the small projection 6 does not intrude into the secondary groove 4*b* during normal use. However, when the small projection 6 is near the entrance of the secondary groove 4*b* (the part corresponding to 4*c* in FIG. 7, hereinafter the same), if a force is applied from outside, for example, if the stick-type cosmetic is dropped or if reaction to the force for using the cosmetic occurs in the direction to the secondary groove 4*b*, the small projection 6 may accidentally intrude into the secondary groove 4*b*. The small projection 6 can be prevented from accidentally intruding into the secondary groove 4*b* by providing the small projection 6 with a resistive section 16 as shown in FIG. 9. To increase this preventing effect, when the small projection 6 is provided with the resistive section 16, it is preferable to make the length x between the upper end of the small projection 6 and the lower end of the resistive section 16 longer than the width of the entrance 4*c*.

Figure 10:
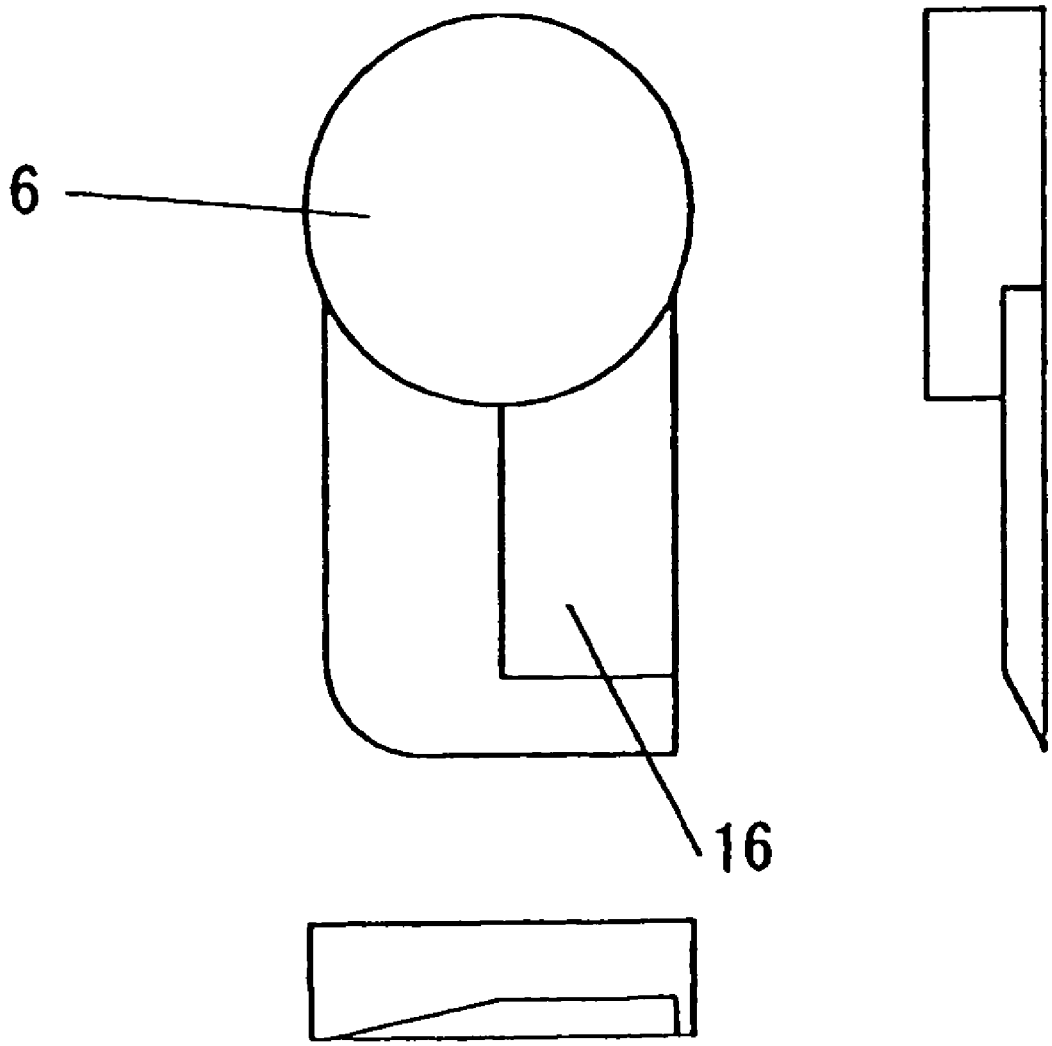
FIG. 10 is a drawing showing another example of the small projection provided with the resistive section as shown in FIG. 9, where a corner in the resistive section is cut off. In the drawing, the view on the left is a front view, the view on the right is a right side view, and the view on the lower left is a bottom view.

In the case where the small projection 6 is provided with the resistive section 16, when a new inner container 5 is inserted in the sleeve 2 by component replacement or the like, if a corner 17 of the resistive section 16 contacts the end of the secondary groove 4*b* during movement of the small projection 6 from the secondary groove 4*b* to the inner container guiding groove 4, the corner 17 may be cut off by making a part of the contacting side of the resistive section 16 a slope. FIG. 10 shows an example of the small projection 6 in which the side of the corner 17 (left side in FIG. 10) contacting the secondary groove 4*b* in the inner container guiding groove 4 as shown in FIG. 7 is cut off.

Figure 8:
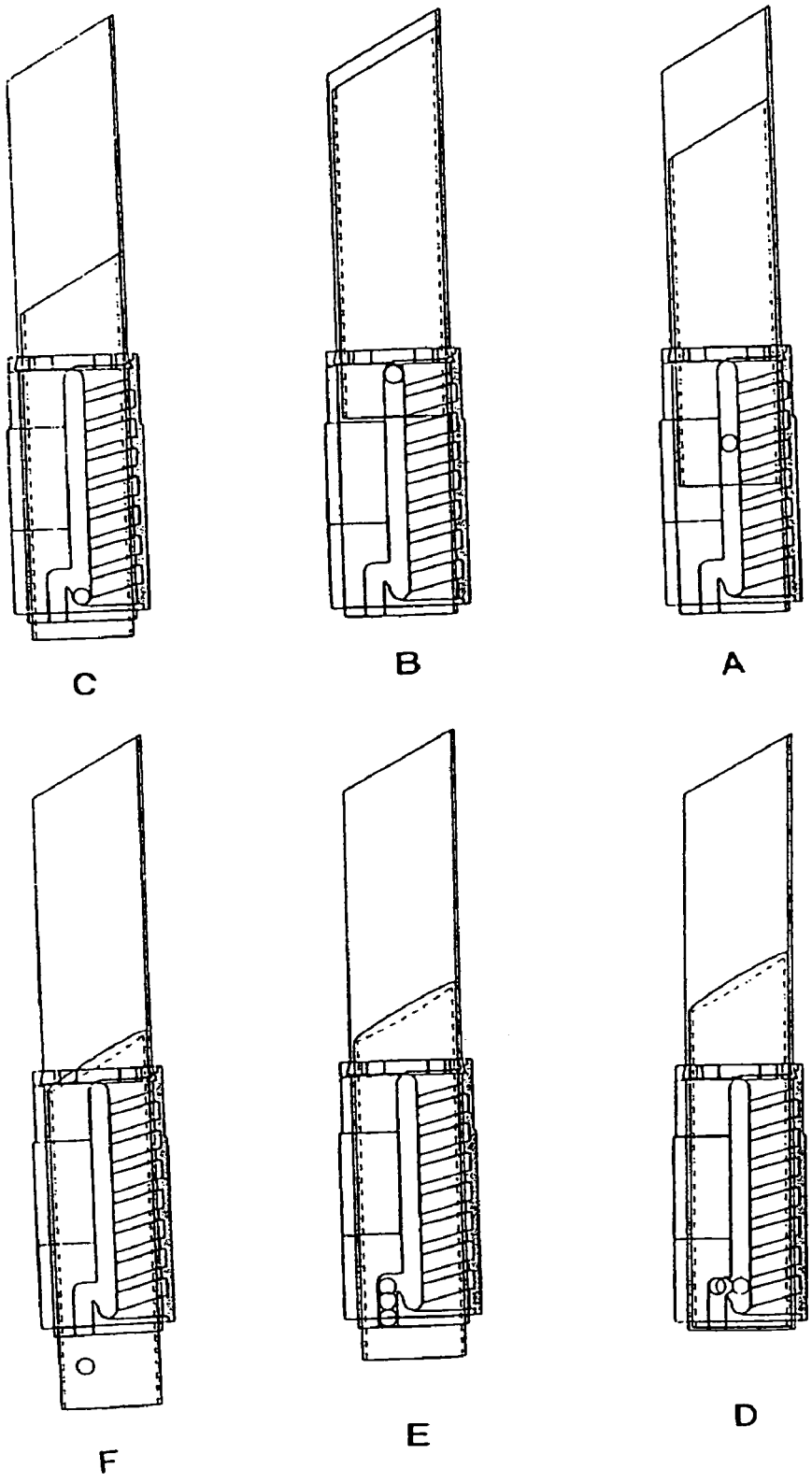
FIG. 8 is a drawing showing movements of the members in the normal state (A-C) and movements of the members during replacement of the inner container (C-F) in the internal structure as shown in FIG. 2.

The disassembly procedure of the stick-type cosmetic container in the case where the stick-type cosmetic filled in the inner container 5 is used up, for example, will be described with reference to FIG. 8.

First, the bottom lid or bottom sticker (not shown) of the stick-type cosmetic is removed if present to make the inner container 5 visible. Second, the small projection 6 is moved so that the inner container 5 can be moved down, followed by storing the small projection 6 in the lowermost part 14 of the inner container guiding groove 4*a* (C in FIG. 8). Third, the small projection 7 is moved to the entrance to the secondary groove 4*b* by rotating the rotational cylinder 7 to the right (D in FIG. 8; rotated about 30° from the position of C). Fourth, the small projection 6 is moved in the leftward direction by an appropriate means such as a jig, followed by rotating the rotational cylinder 7 to the left (E in FIG. 8). The inner container 5 is thus ejected downward via the secondary groove 4*b* opened downward (F in FIG. 8).

Installation of a new inner container 5 as component replacement is carried out by inserting the container 5 from the bottom of an internal structure 1. This insertion is performed by mating the thread on the secondary groove 4*b*, letting the small projection 6 in the inner container 5 into this section, and then rotating the rotational cylinder 7 to the right. Since a force in the upper rightward direction is applied to the small projection 6 in the secondary groove 4*b* by the screw 8 in the rotational cylinder 7, the projection 6 can enter the primary groove of the inner container guiding groove 4 via the secondary groove 4*b*.

Another feature of the present invention is that an outer cylinder 12 and a junction 13 that have been necessary in a conventional manner are not required. This feature is realized by a means by which the rotational cylinder 7 and the sleeve 2 can be rotatably joined. In the present embodiment, a plurality of the pawls 9 is provided in the upper part of the rotational cylinder 7, and a cyclic rib 3 is provided approximately at the center of the outer surface of the sleeve 2. The pawls 9 are engaged with the cyclic rib 3 to rotatably join the rotational cylinder 7 and the sleeve 2. In this manner, a force by which the rotational cylinder 7 is disengaged at the upper limit and the lower limit of the inner container 5 is not applied to the rotational cylinder 7. The rotational cylinder 7 and the sleeve 2 can be detachably joined.

Figure 1:
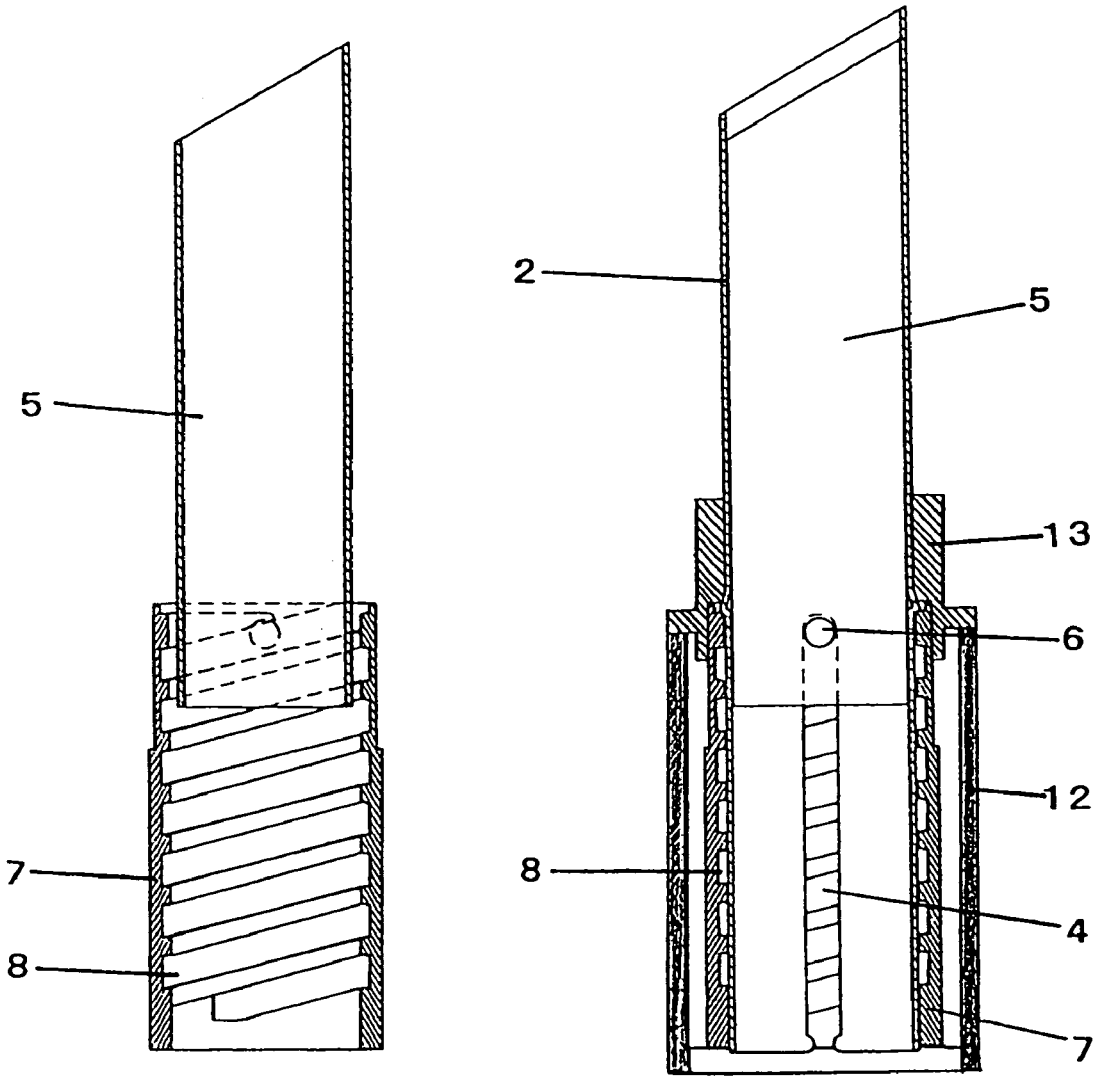
FIG. 1 is a drawing showing a configuration of a conventional stick-type cosmetic container.

As shown in FIG. 1, a conventional stick-type cosmetic container comprises the rotational cylinder 7, sleeve 2, inner container 5, outer cylinder 12, and junction 13. The rotational cylinder 7 and the outer cylinder 12 are joined via the junction 13. The rotational cylinder 7 is rotated by rotating the outer cylinder 12 so that the stick-type container filled in the inner container 5 is let out. By contrast, the pawls 9 in the rotational cylinder 7 are engaged with the cyclic rib 3 in the sleeve 2 to rotatably join the rotational cylinder 7 and the sleeve 2 in the present invention, as described above. Therefore, the inner container 5 can be moved up and down by the rotation involving the two members.

The stick-type cosmetic container of the present invention comprises the internal structure 1 having the rotational cylinder 7, the sleeve 2, and the inner container 5. The internal structure 1 is detachably attached to the exterior outer cylinder 12 to form a container. Various designs can be made for the outer cylinder 12. If the rotational cylinder 7 is colored, designed, or attached to a lid having a shape corresponding to the cylinder 7, the internal structure 1 can be a stick-type cosmetic container having a small number of components. The internal structure 1 can thereby be commonly used for various types of stick-type cosmetic containers. Filling, disassembly, and replacement of the inner container 5 can be carried out for the internal structure 1. When the internal structure 1 is detachably incorporated in the outer cylinder 12 or an exterior container including the cylinder 12, separate disposal after use is possible.

It is possible to construct the stick-type cosmetic container of the present invention as a conventional stick-type cosmetic container by securing the outer cylinder 12 to the rotational cylinder 7 by any means and attaching a necessary lid.

As an example of the method for assembly of the internal structure 1 used in the stick-type cosmetic container of the present invention, the following method can be given. First, the cyclic rib 3 approximately at the center of the sleeve 2 is engaged with the pawls 9 in the rotational cylinder 7 to rotatably join the sleeve 2 and the rotational cylinder 7. Second, the thread in the lower part of the rotational cylinder 7 and the secondary groove 4*b* are mated. The small projection 6 is allowed to pass through this section so that the inner container 5 is placed in the sleeve 2. Third, the rotational cylinder 7 is rotated to the right with respect to the sleeve 2 so that the small projection 6 in the inner container 5 is moved from the secondary groove 4*b* to the primary groove of the inner container guiding groove 4. The internal structure 1 is thus formed. The internal structure 1 is incorporated in the outer cylinder 12 or an exterior container including the cylinder 12 to provide a stick-type cosmetic container.

The stick-type cosmetic container of the present invention is filled with a cosmetic in the following manner. First, the top of the sleeve 2 is covered with a cap (not shown), with the small projection 6 in the inner container 5 of the internal structure 1 being positioned near the lower end of the inner container guiding groove 4, so that the cosmetic may not flow out. Second, the molten cosmetic is poured in from the posterior end of the sleeve (into which the inner container is inserted). The poured cosmetic is solidified in the space formed by the cap, sleeve 2, and inner container 5 and becomes stick-shaped.

The stick-type cosmetic is retained by adhesion to the inner container 5 or an escape-preventing projection in the inner container 5, for example. A small clearance is provided by separation of the cosmetic from the sleeve 2 due to reduction in volume by solidification. Therefore, the cosmetic can be moved up and down by rotating the rotational cylinder 7 when the cap is removed.

The primary groove lowermost part 14 in FIG. 7 plays a role in separating a part of the stick-type cosmetic that remains not separated from the inner surface of the sleeve 2 even after the cosmetic is filled and solidified, by causing the inner container 5 to be moved slightly in the upper perpendicular direction before the small projection 6 reaches the entrance of the secondary groove 4*b*. When a force in the rotational direction is applied to the stick-type cosmetic during separation, a force in the crosswise direction to push the stick-type cosmetic toward the sleeve 2 is generated. In this case, the stick-type cosmetic and the inner surface of the sleeve 2 are in contact in a large surface area and are rubbed together. In addition, loosening occurs in the part for retaining the stick-type cosmetic in the inner container 5. Breaks or cracks may thereby occur in the cosmetic. On the contrary, when the primary groove lowermost part 14 has a linear shape as shown in FIG. 7, the initial movement of the small projection 6 and the stick-type cosmetic in the inner container 5 is a upward linear movement and does not include a rotational movement. Therefore, the stick-type cosmetic can be separated from the part of the inner surface of the sleeve 2 to which the cosmetic is attached without breaks or cracks. The length t of the primary groove lowermost part 14 is not specifically limited. However, the length t is preferably 0.3–1.5 mm, and particularly preferably 0.5–1 mm, in terms of attachment or detachment of the inner container 5, for example.

In the internal structure 1 of the stick-type cosmetic container of the present invention, the bottom must be opened, since filling is performed from the bottom and the internal structure 1 is installed from the bottom of the outer cylinder 12. However, the product in this state does not have good appearance. In this case, a bottom lid 10 or a sticker may be attached to the bottom. It is convenient for buying a stick-type cosmetic for replacement if the product number, color tone, or the like is described on a sticker to be attached to the bottom or the bottom lid 10.

The internal structure 1 in the stick-type cosmetic container of the present invention as described above can be formed basicly as a stick-type cosmetic container of which the material, size, shape, and the like are almost the same as those of a stick-type cosmetic container that has been conventionally provided. However, the container of the present invention differs in some respects such as the shape of the sleeve 2, the shape of the upper part of the rotational cylinder 7, and the fact that the screw 8 on the inner surface of the rotational cylinder 7 is threaded to the end in the present invention. The top of the inner container 5 does not necessarily have a spired shape. Any other shape is possible. Various metals and plastics can be used as a material for the sleeve 2, rotational cylinder 7, or inner container 5, as in the case of conventional products. In addition to the metals and plastics, other shape-retaining materials such as papers and ceramics may be used. This applies to a material for the outer cylinder 12 or an exterior container including the cylinder 12.

INDUSTRIAL APPLICABILITY

A feature of the stick-type cosmetic container of the present invention is that the inner container does not drop out during normal use and that disassembly and replacement of the members can be easily carried out using a simple jig or the like when the stick-type cosmetic is used up. The number of members forming the container can be reduced. The materials used can also be rationalized by standardizing the members.

Therefore, the stick-type cosmetic container of the present invention as a product that can save resources and be recycled can be advantageously used for cosmetics such as lipsticks, lip creams, concealers, skin-whitening sticks, and sunburn-preventive sticks.

What is claimed is:

1. A container for a stick-type cosmetic comprising an internal structure that has a rotational cylinder, a sleeve, and an inner container in which a stick-type cosmetic can be filled, and that can project and retract the stick-type cosmetic filled in the inner container when a small projection provided in the inner container is guided by an inner container guiding groove provided in the sleeve and the small projection is moved up and down by a screw threaded on the inner surface of the rotational cylinder, wherein the inner container guiding groove provided in the sleeve in the internal structure comprises a linear primary groove, with the lower end being closed, and a secondary groove branched on the way of the primary groove and having an approximately inverted J shape, with the lower end being opened.

2. The stick-type cosmetic container according to claim 1, wherein the rotational cylinder and the sleeve are provided with a joining means for rotatably joining the rotational cylinder and the sleeve.

3. The stick-type cosmetic container according to claim 2, wherein the joining means comprises a plurality of pawls provided in the upper part of the rotational cylinder and a cyclic rib provided on the outer surface approximately at the center of the sleeve, the pawls being engaged with the cyclic rib to rotatably join the rotational cylinder and the sleeve.

* * * * *

UNITED STATES PATENT AND TRADEMARK OFFICE

CERTIFICATE OF CORRECTION

PATENT NO. : 7,004,656 B2
DATED : February 28, 2006
INVENTOR(S) : Kurihara et al.

It is certified that error appears in the above-identified patent and that said Letters Patent is hereby corrected as shown below:

Title page, Item [54] and Column 1, line 1,
Title, should read -- STICK-TYPE COSMETIC CONTAINER --.

Signed and Sealed this

Thirteenth Day of June, 2006

JON W. DUDAS
*Director of the United States Patent and Trademark Office*